US012655631B1

(12) United States Patent
Russell

(10) Patent No.: US 12,655,631 B1
(45) Date of Patent: Jun. 16, 2026

(54) MODULAR WALL SYSTEM

(71) Applicant: Brian Russell, Lincoln, NE (US)

(72) Inventor: Brian Russell, Lincoln, NE (US)

( * ) Notice: Subject to any disclaimer, the term of this patent is extended or adjusted under 35 U.S.C. 154(b) by 214 days.

(21) Appl. No.: 18/387,247

(22) Filed: Nov. 6, 2023

Related U.S. Application Data

(63) Continuation of application No. 18/118,524, filed on Mar. 7, 2023, now abandoned.

(60) Provisional application No. 63/317,156, filed on Mar. 7, 2022.

(51) Int. Cl.
*E04B 2/82* (2006.01)
*E04B 2/74* (2006.01)

(52) U.S. Cl.
CPC ..... *E04B 2/827* (2013.01); *E04B 2/821* (2013.01); *E04B 2002/7487* (2013.01)

(58) Field of Classification Search
CPC ... E04B 2/827; E04B 2/821; E04B 2002/7487
USPC ..... 52/71
See application file for complete search history.

(56) References Cited

U.S. PATENT DOCUMENTS 3,359,594 A * 12/1967 Beno ..... E06B 3/481 160/199
4,438,605 A * 3/1984 DeLucia ..... E06B 3/486 160/206
9,382,749 B2 * 7/2016 George ..... E06B 3/481

* cited by examiner

*Primary Examiner* — Patrick J Maestri
(74) *Attorney, Agent, or Firm* — Suiter Swantz IP

(57) ABSTRACT

The modular wall system may include a plurality of panels, each panel of the plurality of panels connected to at least one other panel via a connector. The modular wall system may further include a train assembly, wherein the train assembly is coupled to an end of each panel, the train assembly including one or more wheels. The train assembly including one or more wheels may be configured to be moved along a rail track of the modular wall system.

20 Claims, 23 Drawing Sheets

MODULAR WALL SYSTEM

CROSS REFERENCE TO RELATED APPLICATIONS

The present application claims the benefit under 35 U.S.C. § 120 of U.S. patent application Ser. No. 18/118,524 filed Mar. 7, 2023. The U.S. patent application Ser. No. 18/118,524 filed Mar. 7, 2023 claims the benefit under 35 U.S.C. § 119 of U.S. Provisional Application Ser. No. 63/317,156 filed Mar. 7, 2022. The U.S. patent application Ser. No. 18/118,524 filed Mar. 7, 2023 and the U.S. Provisional Application Ser. No. 63/317,156 filed Mar. 7, 2022 are hereby incorporated by reference in their entireties.

TECHNICAL FIELD

The present disclosure relates generally to modular systems and, more particularly, to modular wall systems.

BACKGROUND

Over the years, multiple categories of doors have been developed and distinguished, including, but not limited to, the swinging door, the pocket door, the bifold door, and the sliding door. While these door types each have distinguishing features, they all share common drawbacks. First off, these types of doors require a significant amount of space to operate, which can put a constraint on room size, furniture placement, and floor space. Another drawback is that these door types can be hard to operate for those who fall under the needs of the Americans with Disabilities Act.

For example, the French door takes more room than the length of each panel forward and twice the width within the doorway. With the sliding door, half of the threshold becomes inaccessible due to the length of the door overlapping the other. Pocket doors, though taking up less visible space, still require at least their width inside the wall to operate, requiring designers to elongate certain walls to make a pocket door fit with the wall, which becomes more costly and becomes a burden on the homeowner and inhibits design freedom. Doorways take the least amount of space but offer no privacy.

Accordingly, it may be advantageous for a system to remedy the shortcomings of the conventional approaches identified above.

SUMMARY

Accordingly, the present disclosure is directed to a modular wall system. The modular wall system may include a plurality of panels, each panel of the plurality of panels connected to at least one other panel via a connector. The modular wall system may further include a train assembly, wherein the train assembly is coupled to each panel, the train assembly including one or more wheels. The train assembly including one or more wheels may be configured to be moved along a rail track of the modular wall system.

It is to be understood that both the foregoing general description and the following detailed description are exemplary and explanatory only and are not necessarily restrictive of the present disclosure. The accompanying drawings, which are incorporated in and constitute a part of the specification, illustrate the subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
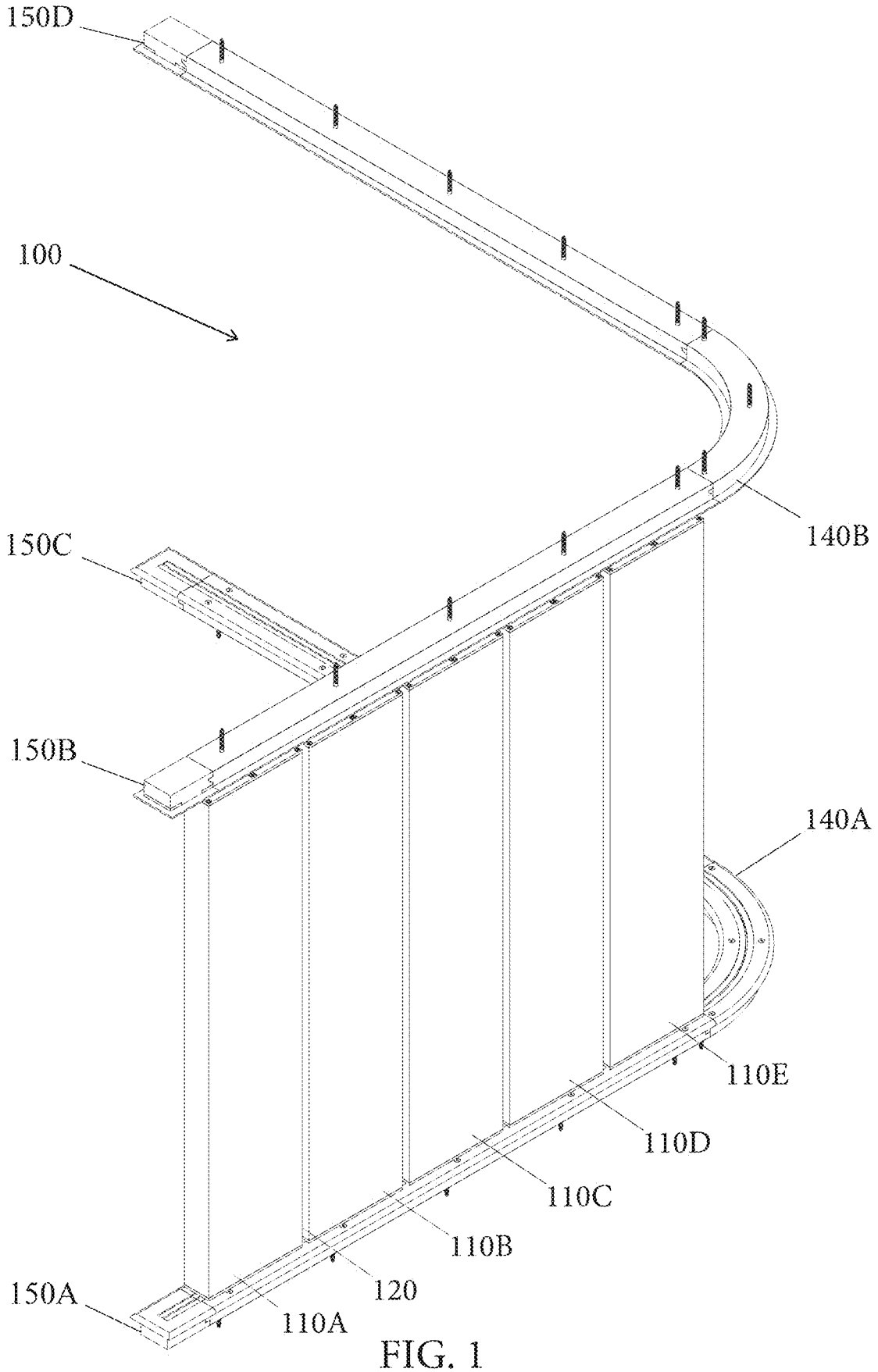
FIG. 1 illustrates a modular wall system in accordance with one or more embodiments of the present disclosure.

Before explaining one or more embodiments of the disclosure in detail, it is to be understood that the embodiments are not limited in their application to the details of construction and the arrangement of the components or steps or methodologies set forth in the following description or illustrated in the drawings. In the following detailed description of embodiments, numerous specific details may be set forth in order to provide a more thorough understanding of the disclosure. However, it will be apparent to one of ordinary skills in the art having the benefit of the instant disclosure that the embodiments disclosed herein may be practiced without some of these specific details. In other instances, well-known features may not be described in detail to avoid unnecessarily complicating the instant disclosure.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination or sub-combination of two or more such features, along with any other features which may not necessarily be expressly described or inherently present in the instant disclosure.

Reference will now be made in detail to the subject matter disclosed, which is illustrated in the accompanying drawings.

Embodiments of the present disclosure are directed to a modular wall system. It is contemplated that while the modular wall system may be employed as a door, it is contemplated that the modular wall system may be employed as a window covering, security device, adjustable wall, and the like without departing from the scope and intent of the present disclosure.

Figure 2:
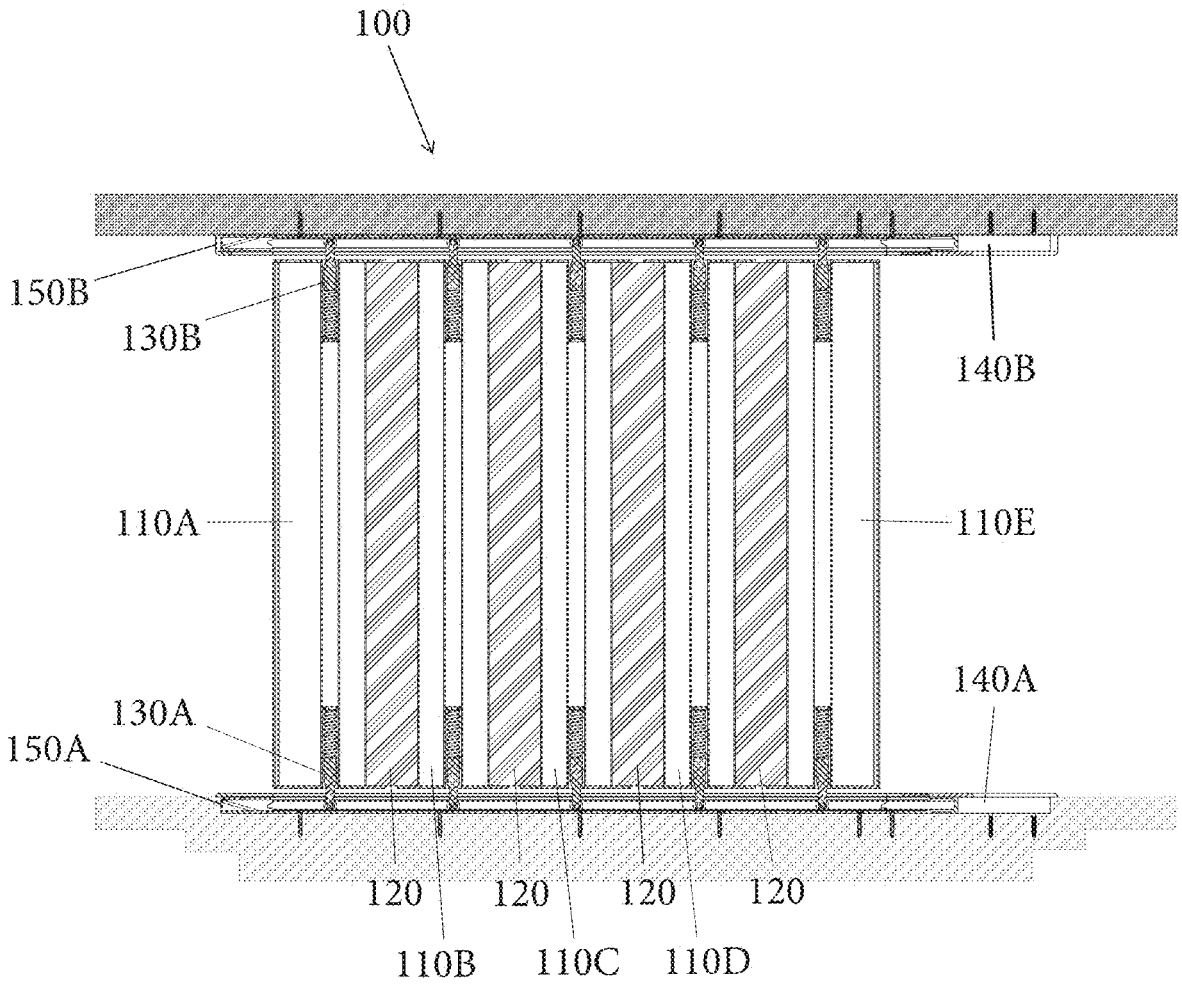
FIG. 2 illustrates a cross sectional view of the modular wall system in accordance with one or more embodiments of the present disclosure.

Referring to FIG. 1, a modular wall system 100 in accordance with one or more embodiments of the present disclosure is shown. The modular wall system 100 may include one or more panels 110A-110E, connected using one or more connectors 120. The modular wall system 100 may further include a train assembly 130A, 130B, wherein the train assembly 130A, 130B is coupled to each panel, the train assembly 130A, 130B including one or more wheels as shown in FIG. 2. The one or more wheels of the train assembly 130A, 130B may be configured to be retained and moved along a rail track 140A, 140B. It is contemplated that one or more panels 110A-110E may include one or more center panels 110B-110D, a first end panel 110A, and a second end panel 110E. In an embodiment, each panel of the one or more panels 110A-110E may be rectangularly shaped. In another embodiment, panels 110B-110D may be shaped in a trapezoidal form, however, first end panel 110A and second end panel 110E may include a rectangular edge on the first side of first end panel 110A and the second side of second end panel 110E.

Modular wall system 100 may include insertion assembly 150 for installation and removal of the panels 110A-110E. The insertion assembly 150 may be placed at each end of a rail track to allow insertion of the train assembly and panels to form a modular wall. For example, insertion assemblies 150A, 150C are located on lower rail track 140A and insertion assemblies 150B, 150D are located on upper rail track 140B. In an alternative embodiment, it is contemplated that only one insertion assembly may be included for each rail track 140A, 140B, for example, insertion assembly 150A for rail track 140A and insertion assembly 150B for rail track 140B.

Referring to FIG. 2, another view of the modular wall system 100 in accordance with one or more embodiments of the present disclosure is shown. The plurality of panels 110A-110E may be interconnected via a connector 120. Each panel 110A-110E may include a train assembly 130A. The train assembly 130A may include one or more wheels and may be connected to a rail track 140A. As shown in FIG. 2, the modular wall system 100 may include a train assembly 130A coupled to rail track 140A and may include a train assembly 130B coupled to a rail track 140B. In an alternative embodiment, it is contemplated that modular wall system 100 may include a single rail track, such as rail track 140B, and train assembly 130B may be coupled to the rail track 140B. In this embodiment, rail track 140A and train assembly 130A may not be included within the modular wall system 100.

Figure 3:
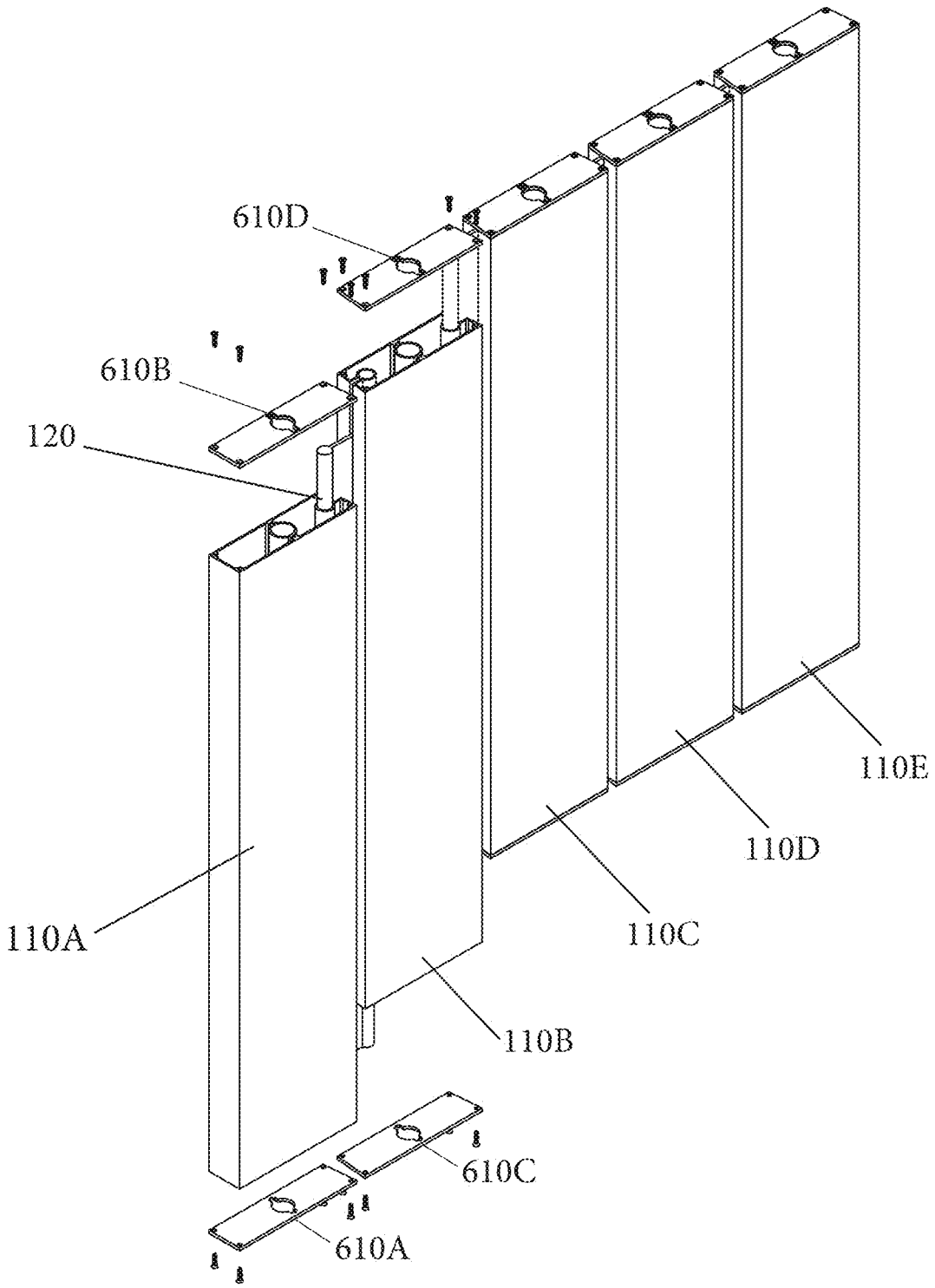
FIG. 3 illustrates an exploded view of the plurality of panels of the modular wall system in accordance with one or more embodiments of the present disclosure.

It is contemplated that each rail track 140A, 140B may be fixed to their desired locations through one or more fasteners which are inserted into corresponding chamfered holes of the rail track from the interior of each rail track. In embodiments, the lower track 140A may be inserted into the floor and upper track 140B may be inserted into the ceiling, in the desired location where the modular wall system is to operate. However, the rail track 140A, 140B may be attached to the desired locations, e.g. a floor and ceiling respectively, through use of other fastening techniques, such as adhesives, brackets, and the like, and combinations of the same, without departing from the scope and intent of the present disclosure. Although at least FIGS. 1-3 depict the modular wall system 100 including vertical panels 110A-110E configured for horizontal movement, it is contemplated that the modular wall system 100 may include horizontal panels 110A-110E configured for vertical movement. For example, the modular wall system 100 may come down from a ceiling, where the rail track may be fixed to the ceiling or wall via one or more fasteners. By way of another example, the modular wall system 100 may come up from a floor, where the rail track may be fixed to floor or wall via one or more fasteners.

Referring to FIG. 3, an exploded view of the plurality of panels 110A-110E of the modular wall system 100 in accordance with one or more embodiments of the present disclosure is shown. The plurality of panels 110A-110E may be interconnected via a connector 120. The connector 120 may run a length of the panel according to one embodiment of the disclosure. It is contemplated that the connector 120 may be formed of any flexible material known in the art including, but not limited to, a strong flexible rubber and the like.

Figure 5A:
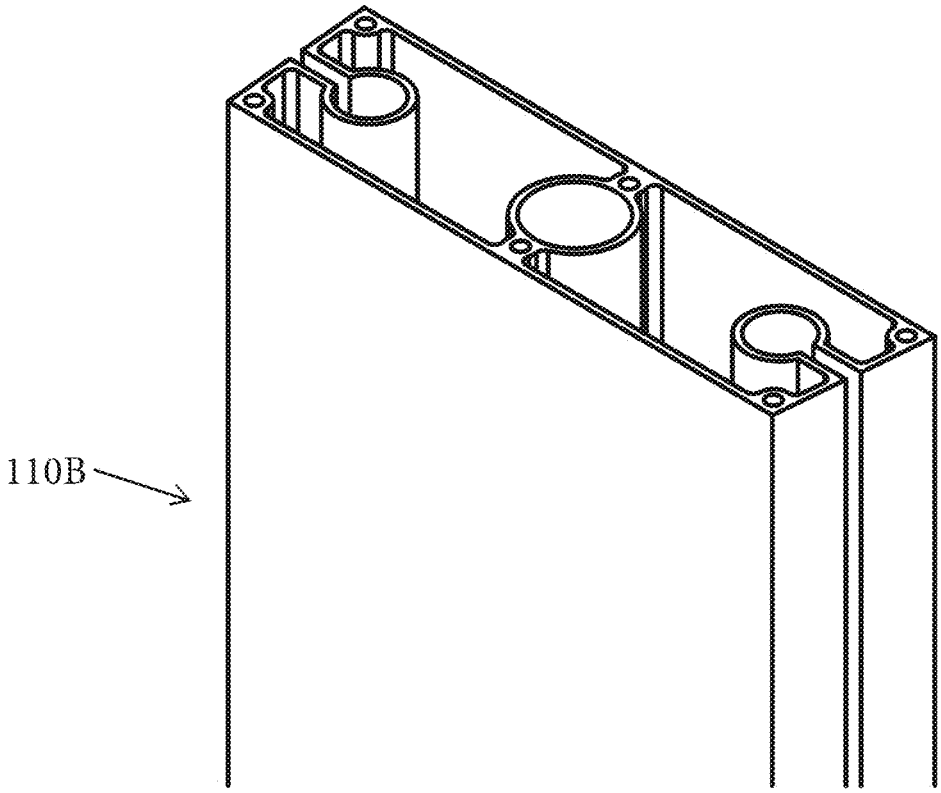
FIG. 5A illustrates a view of a center panel of the modular wall system in accordance with one or more embodiments of the present disclosure.
Figure 5B:
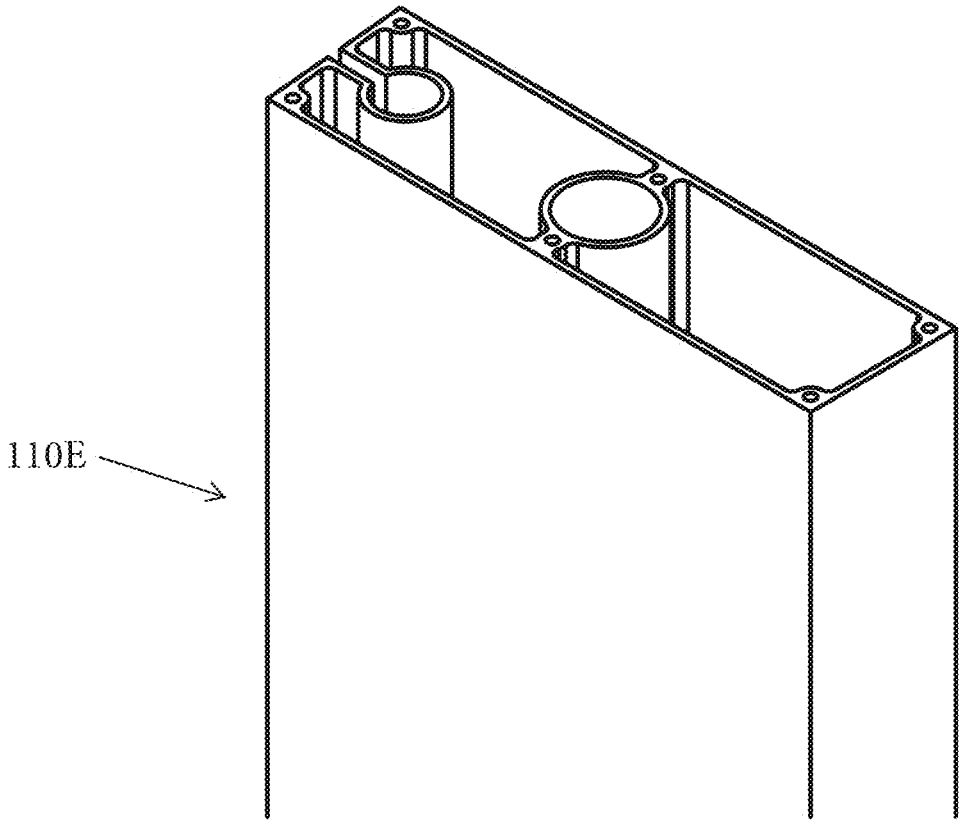
FIG. 5B illustrates a view of an end panel of the modular wall system in accordance with one or more embodiments of the present disclosure.

The panels 110A-110E may include center panels 110B-110D and may include one or more end panels 110A, 110E. It is contemplated that center panels 110B-110D may include slots on each side of the panel as shown in an exemplary manner in FIG. 5A. End panels 110A, 110E may include a single slot and may include a generally flat side as shown in an exemplary manner in FIG. 5B. Advantageously, one or more center panels 110B-110D may be added to suit a particular application, whereby inventory and parts may be easily maintained to work with a number of types of applications.

Figure 6A:
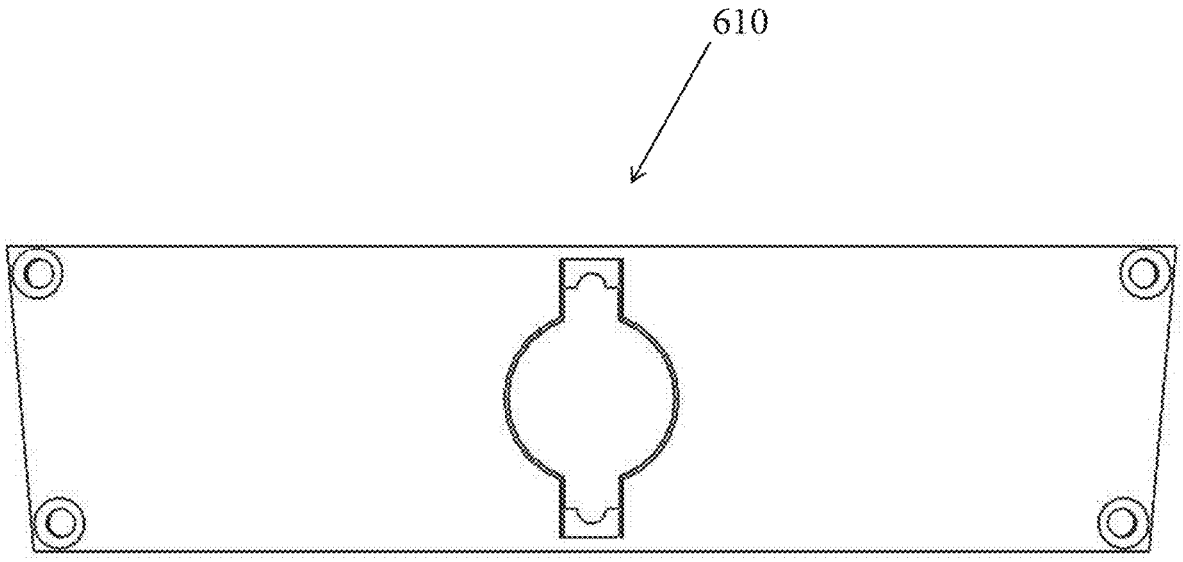
FIG. 6A illustrates a view of a plate that connects to an end of a center panel of the modular wall system in accordance with one or more embodiments of the present disclosure.
Figure 6B:
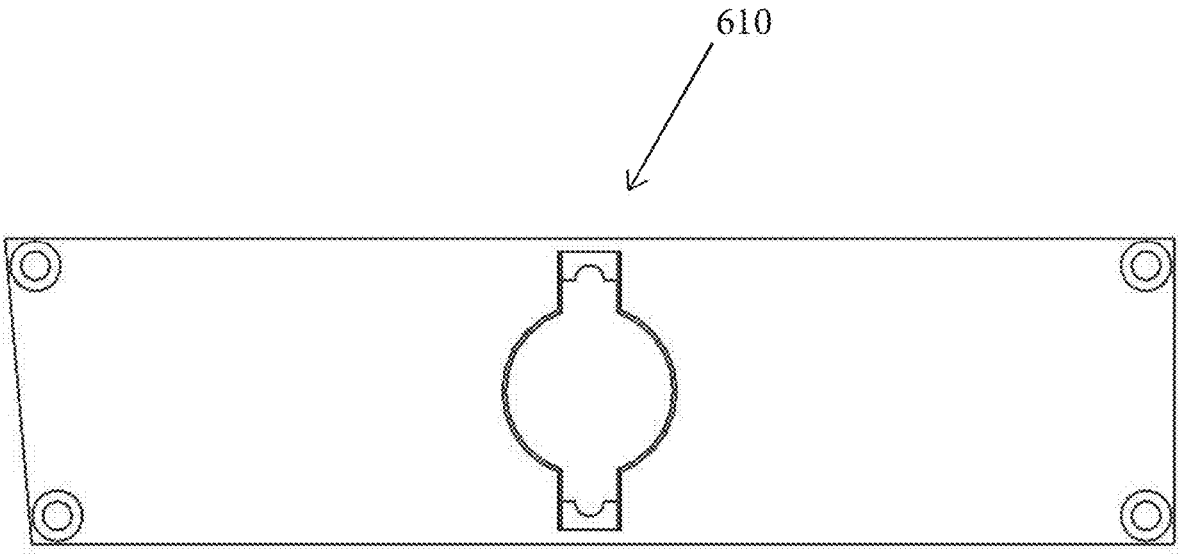
FIG. 6B illustrates a view of a plate that connects to an end of a first end panel of the modular wall system in accordance with one or more embodiments of the present disclosure.
Figure 6C:
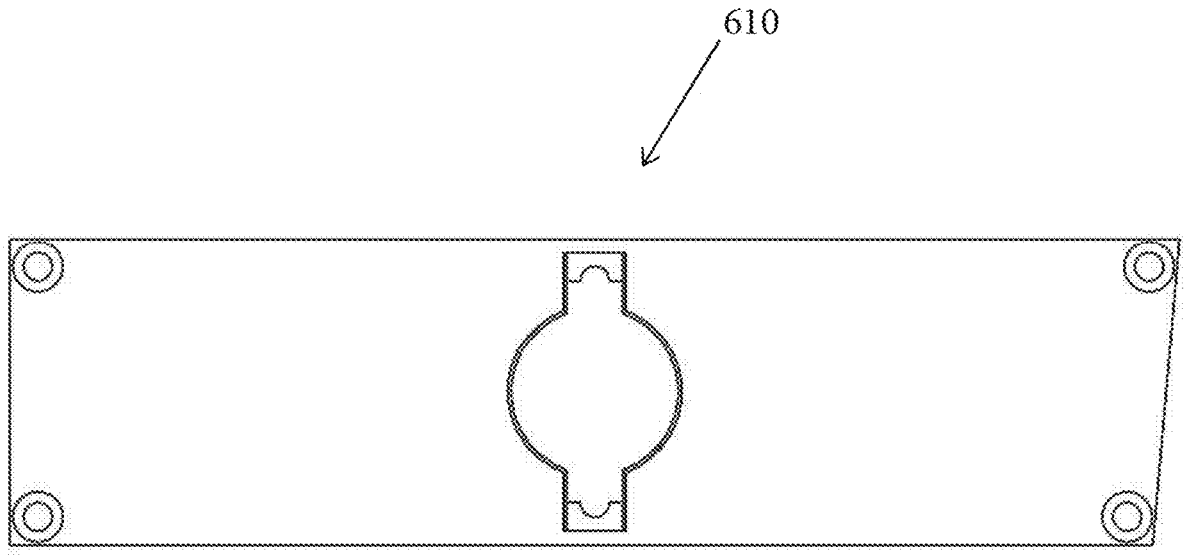
FIG. 6C illustrates a view of a plate that connects to an end of a second end panel of the modular wall system in accordance with one or more embodiments of the present disclosure.

Each panel may include a plate 610 on each side and may be coupled to the panels via fasteners and the like. The plate 610 may be shown in an exemplary manner in FIGS. 6A, 6B and 6C. The plate 610 as shown in FIG. 6A may be suitable for a bottom or top plate of a center panel 110B-110D, such as plates 610C, 610D in FIG. 3. The plate 610 as shown in FIG. 6B may be suitable for a top plate of first end panel 110A or a bottom plate of second end panel 110E, such as plate 610B of FIG. 3. The plate 610 as shown in FIG. 6C may be suitable as a bottom plate of first end panel 110A or a top plate of second end panel 110E, such as plate 610A. The plate 610 may include a hole through which the train assembly 130 may be inserted to couple to the panel.

Figure 4A:
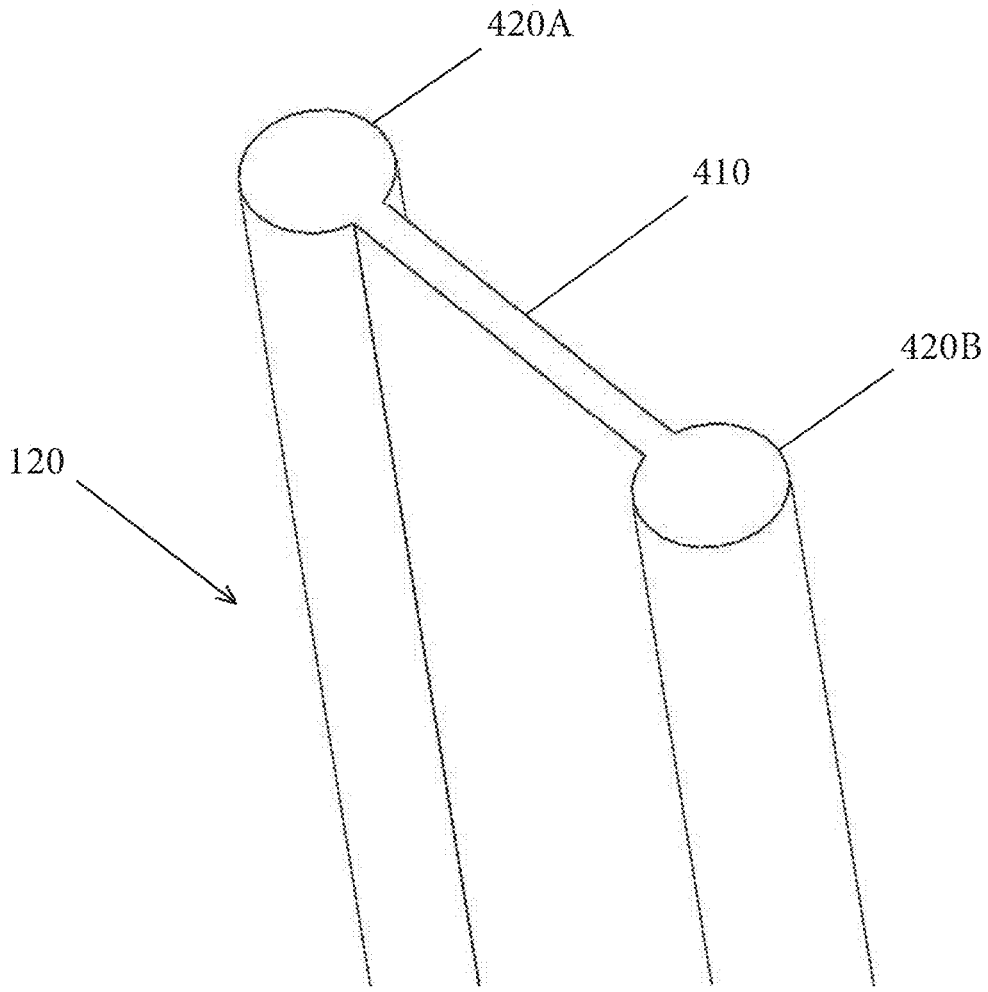
FIG. 4A illustrates a view of a connector of the modular wall system in accordance with one or more embodiments of the present disclosure.
Figure 4B:
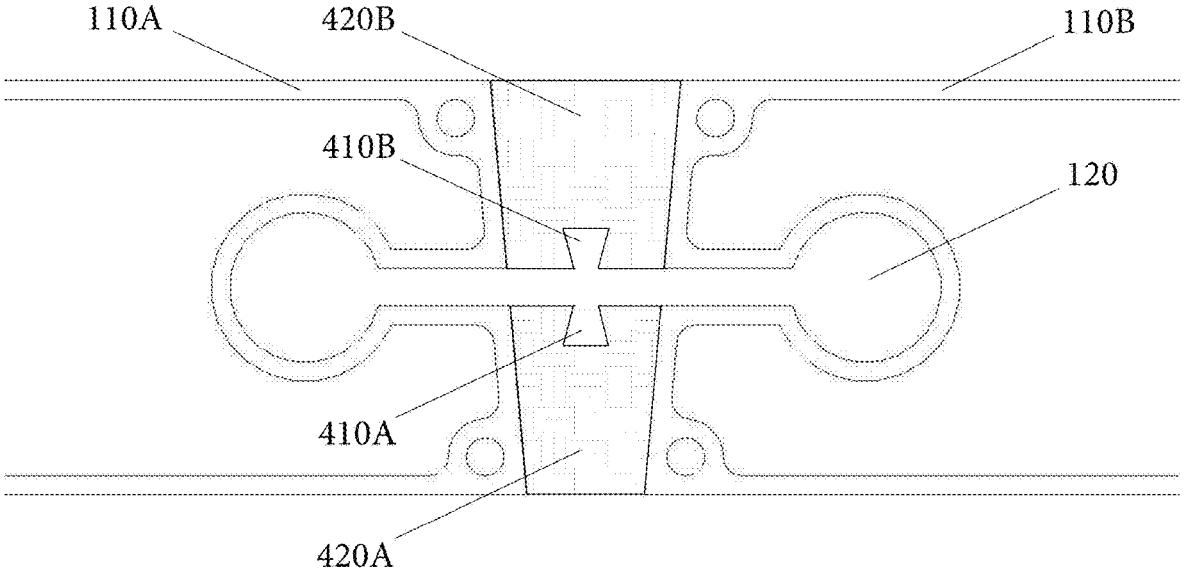
FIG. 4B illustrates a top view of a connector of the modular wall system in accordance with one or more embodiments of the present disclosure.

Referring to FIGS. 4A and 4B, connector 120 may include a generally flat section 410 and may include rounded edges 420A, 420B at each end of the connector 120, wherein the rounded edges 420A, 420B are configured to be secured within slots of the panels as shown in FIG. 4B. It is further contemplated that connector 120 may include one or more extrusions 410A, 410B on each side of the flat section. Extrusion 410A, 410B may run the length of the connector 120. It is contemplated that gap filler member 420A, 420B may be slid onto the extrusion 410A, 410B. The gap filler member 420A, 420B may fill a gap space between two panels that may be formed as the panels may include a trapezoidal shape as viewed from the top view as shown in FIG. 4B. The gap filler member 420A, 420B may prevent injury to a user's fingers which may be within the area between two panels and being moved. Also, gap filler member 420A, 420B may create additional security protection and additional fire protection for the modular wall system. It is contemplated that gap filler member 420A, 420B may be formed of a flexible material, such as shock absorbing polyurethane, rubber, and the like. It is contemplated that it may be desirable to present a decorative design to the generally flat section 410 of the connector, or to the exterior portion of the gap filler members 420A, 420B. It is contemplated that the generally flat section 410 and gap filler members 420A, 420B may include a veneer material, metallic covering, a stylized design, and the like which may be similar to the desired appearance of the panels 110A-110E, or may be selected to contrast the appearance of the panels 110A-110E which would be desired by a user.

It is contemplated that if the modular wall system 100 is of a significant size and length, it may be desirable to increase strength of the connector 120. In one embodiment, it is contemplated that the generally flat section 410 of the connector could include a reinforcing material to provide added strength, such as a carbon fiber mesh, metal inserts, and the like which could increase the strength of the connector 120. Additionally, it is contemplated that an additional connecting member could be attached and connect adjacent panels by connecting to the one or both of the upper plates and lower plates of adjacent panels. The additional connecting member may be fastened to the plate in a similar location as the rounded edges 420A, 420B of the connector as viewed in a top view as shown in FIG. 4B. It is contemplated that the additional connecting member could be fastened to the plates in a manner that allows the connecting member to rotate and pivot which is desirable to allow the modular wall system to travel in a curved manner. The additional connecting member may be formed of a rigid material, such as metal, plastic, and the like.

Referring once again to FIG. 3, panels 110A-110E may be formed of any rigid material, including wood, metal, plastic, composite, and the like, and may be formed of a generally rectangular shape and may include hollow space within the panel. It is contemplated that in some embodiments the panels 110A-110E may include a decorative finish including, but not limited to, paint, veneer (e.g., wood veneer), stain, metal plate, fabric, and the like. The plates may also be formed of a rigid material, including, but not limited to, metal, plastic, composite, and the like. It is contemplated that the panels 110A-110E may include insulation, foam, and the like to improve thermal, acoustic, and fortifying properties of the modular wall system 100. For example, it is contemplated that foam may be added which may provide increased strength and rigidity to the panels 110A-110E which may enable the system to provide enhanced security advantages. In an alternative embodiment, the panels 110A-110E may be formed of a solid material, such as wood, metal, plastic, composite, and the like. In such a fashion, it is contemplated that the slots and receptacle for the train assembly may be bored into the panel 110A-110E and include a plate as shown in FIG. 6A-6C, in order to operate in a similar manner as the modular wall system 100 as shown in FIGS. 1-3.

Figure 7:
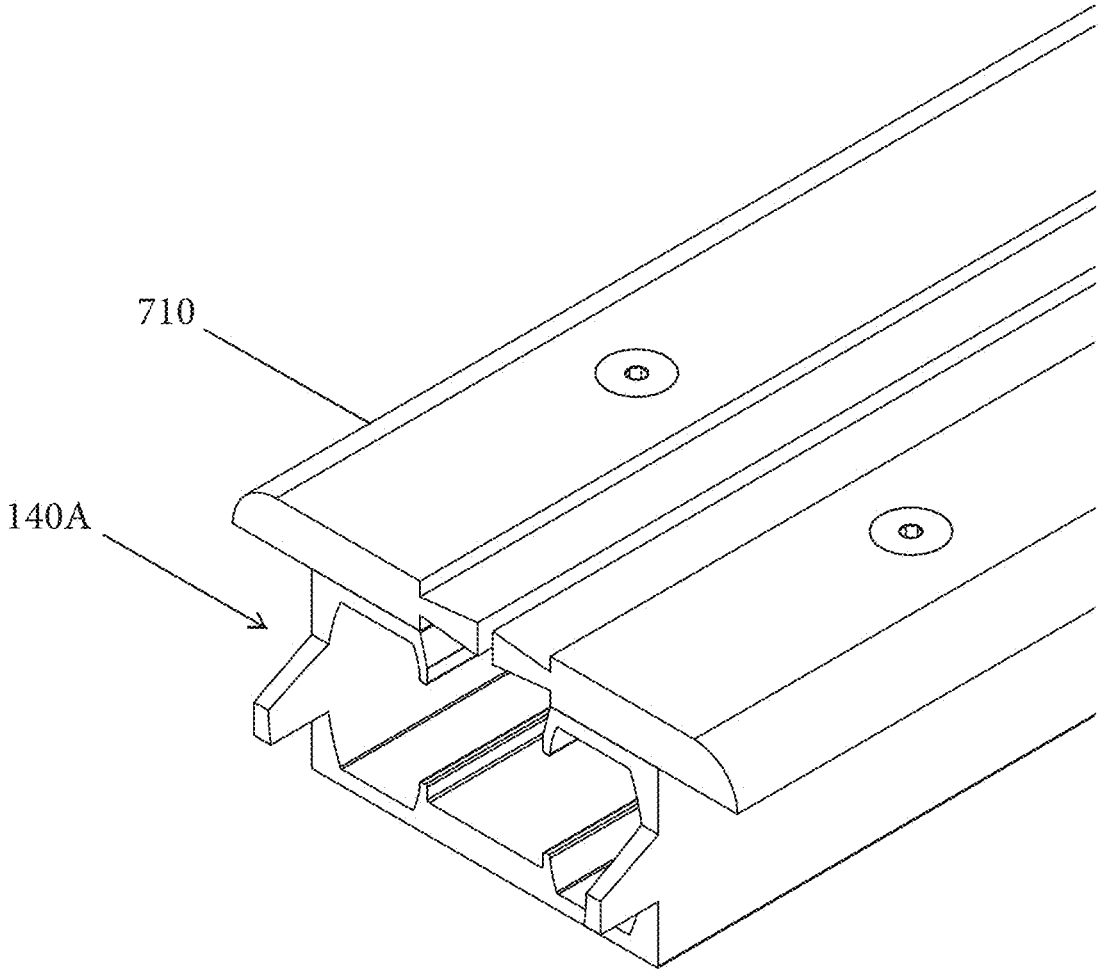
FIG. 7 illustrates an assembled view of a rail track of the modular wall system in accordance with one or more embodiments of the present disclosure.
Figure 8:
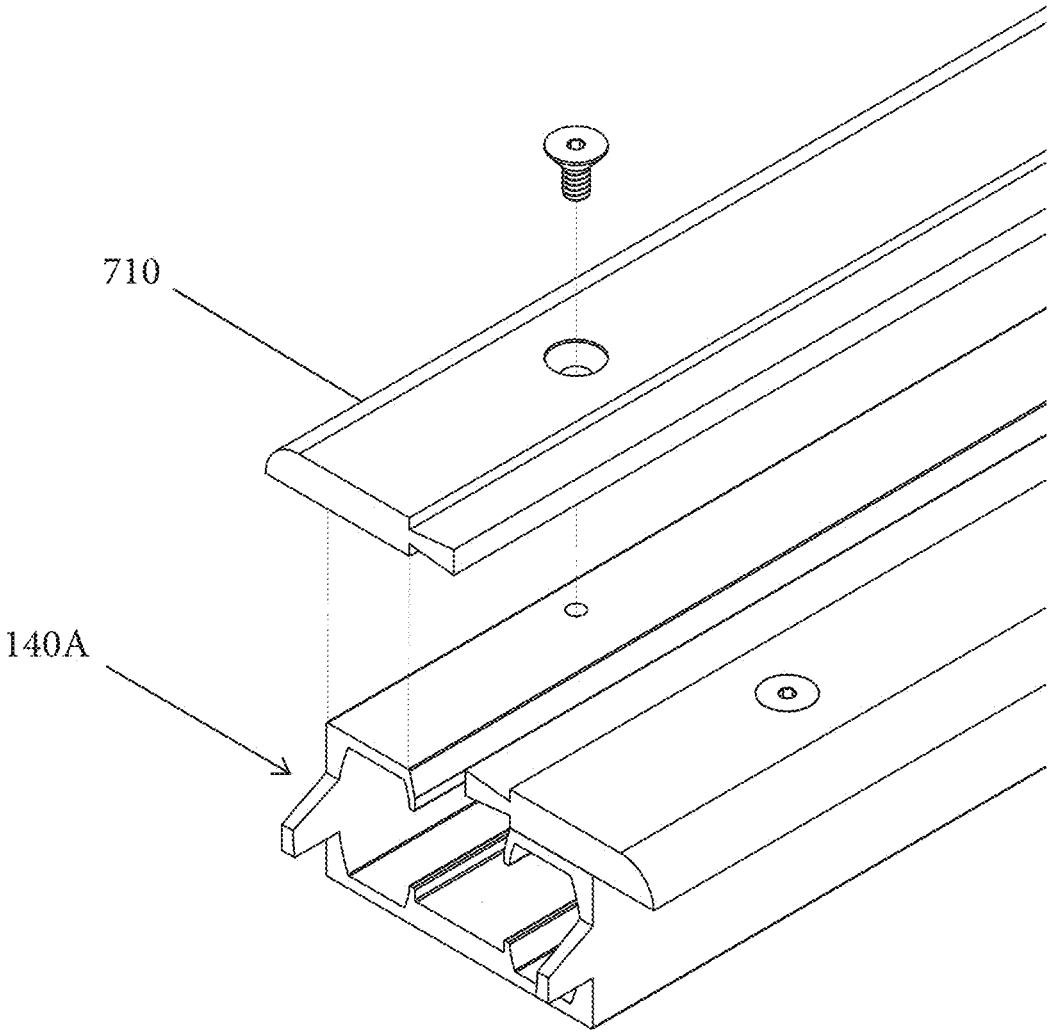
FIG. 8 illustrates another exploded view of a rail track of the modular wall system in accordance with one or more embodiments of the present disclosure.

Referring to FIG. 7, an assembled view of a rail track 140A of the modular wall system in accordance with one or more embodiments of the present disclosure is shown. In embodiments, the rail track 140A may include one or more bristle bars 710, wherein the one or more bristle bars 710 include one or more threaded holes which are aligned with the threaded holes of the rail track 140A and held in place using one or more fasteners. The one or more bristle bars 710 may offer protection from debris that may fall into the rail track 140A which may inhibit proper function of the modular wall system. As shown specifically in FIG. 11, one or more bristle bars 710 may include a tapered edge to allow a transition of the rail track 140A to the floor area adjacent the rail track 140A. Further, the one or more bristle bars 710 may be utilized for security and/or fire protection. The one or more bristle bars may be utilized and made of other track protection materials other than bristles in order to create additional security and/or fire protection. It is contemplated that the additional security and/or fire protection materials may be formed of any flexible material known to the art including, but not limited to, a strong flexible rubber, weather stripping, fire resistant foam, and the like.

Figure 9:
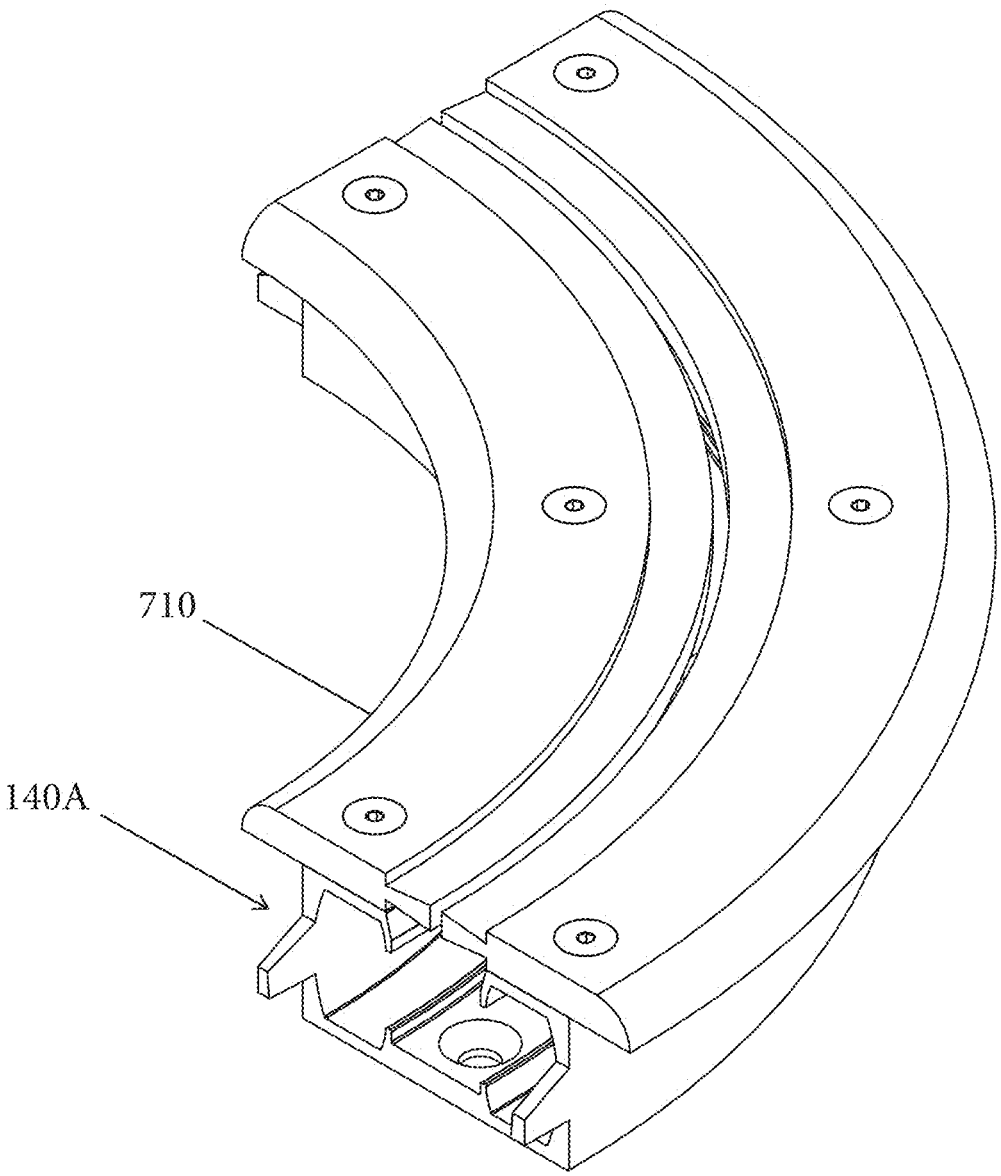
FIG. 9 illustrates an assembled curved rail track section of the modular wall system in accordance with one or more embodiments of the present disclosure.
Figure 10:
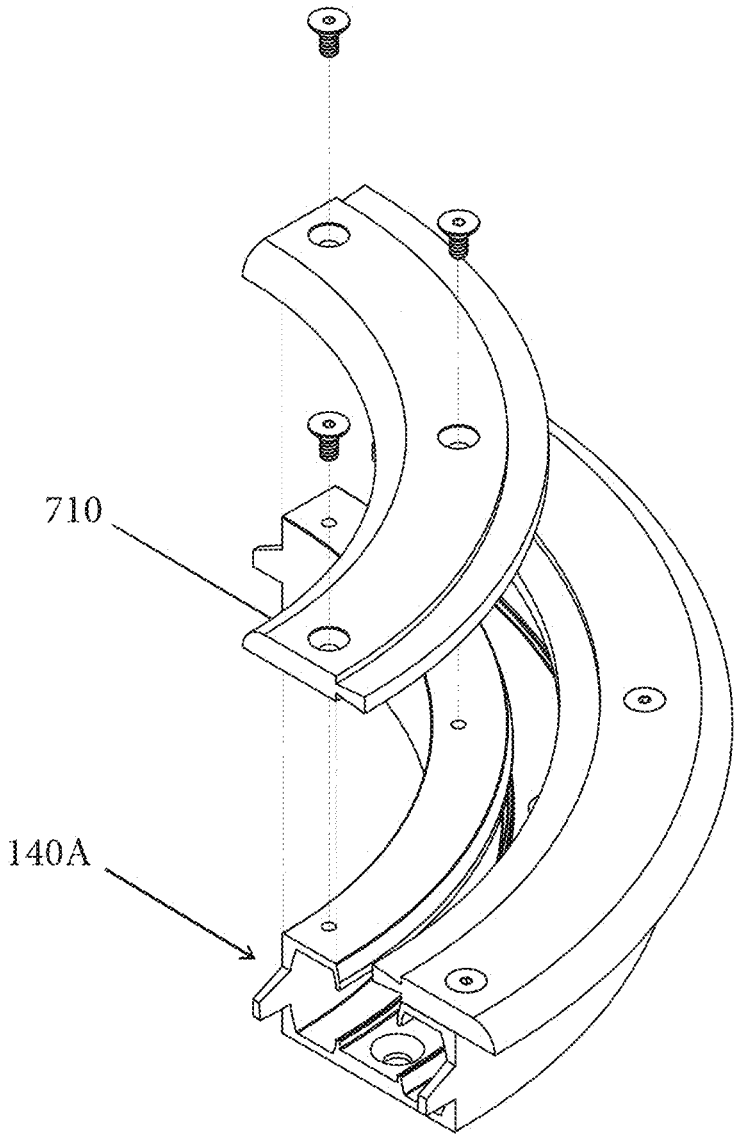
FIG. 10 illustrates another exploded view of a curved rail track section of the modular wall system in accordance with one or more embodiments of the present disclosure.
Figure 11:
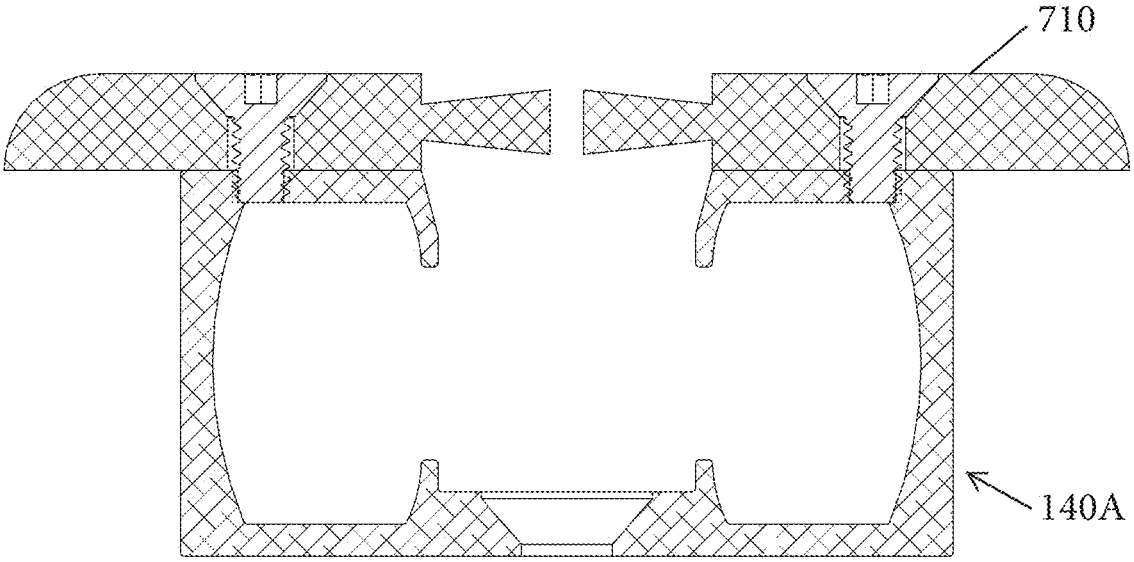
FIG. 11 illustrates a cross sectional view of an assembled rail track of the modular wall system in accordance with one or more embodiments of the present disclosure.

It is contemplated that the rail track 140A may include one or more track sections which may be coupled together, and may include generally straight track sections and curved tracked sections as shown in an exemplary manner in FIGS. 9-10. The one or more sections may be coupled together via fasteners, or may include a tension or interlocking fit, and may include male pins and corresponding female receptacles according to various embodiments of the present disclosure. In embodiments, the rail track 140A may include one or more lower surfaces in which the one or more wheels of the train assembly may roll as shown in FIG. 11. In embodiments, the rail track 140A may be made of any material known in the art including, but not limited to, metal, plastic, composite, and the like. It is contemplated that the curved track sections may be presented at any desired angle such as, but not limited to, 15, 22.5, 30, 45, 60, 90, 105, 112.5, 120, 135, 150, 180, 195, 202.5, 210, 225, 240, 270, 285, 292.5, 300, 315, 330, 360 degree curves. While it is described with respect to rail track 140A, it is contemplated that FIGS. 7-13 and their corresponding description are applicable for rail track 140B.

Figure 12:
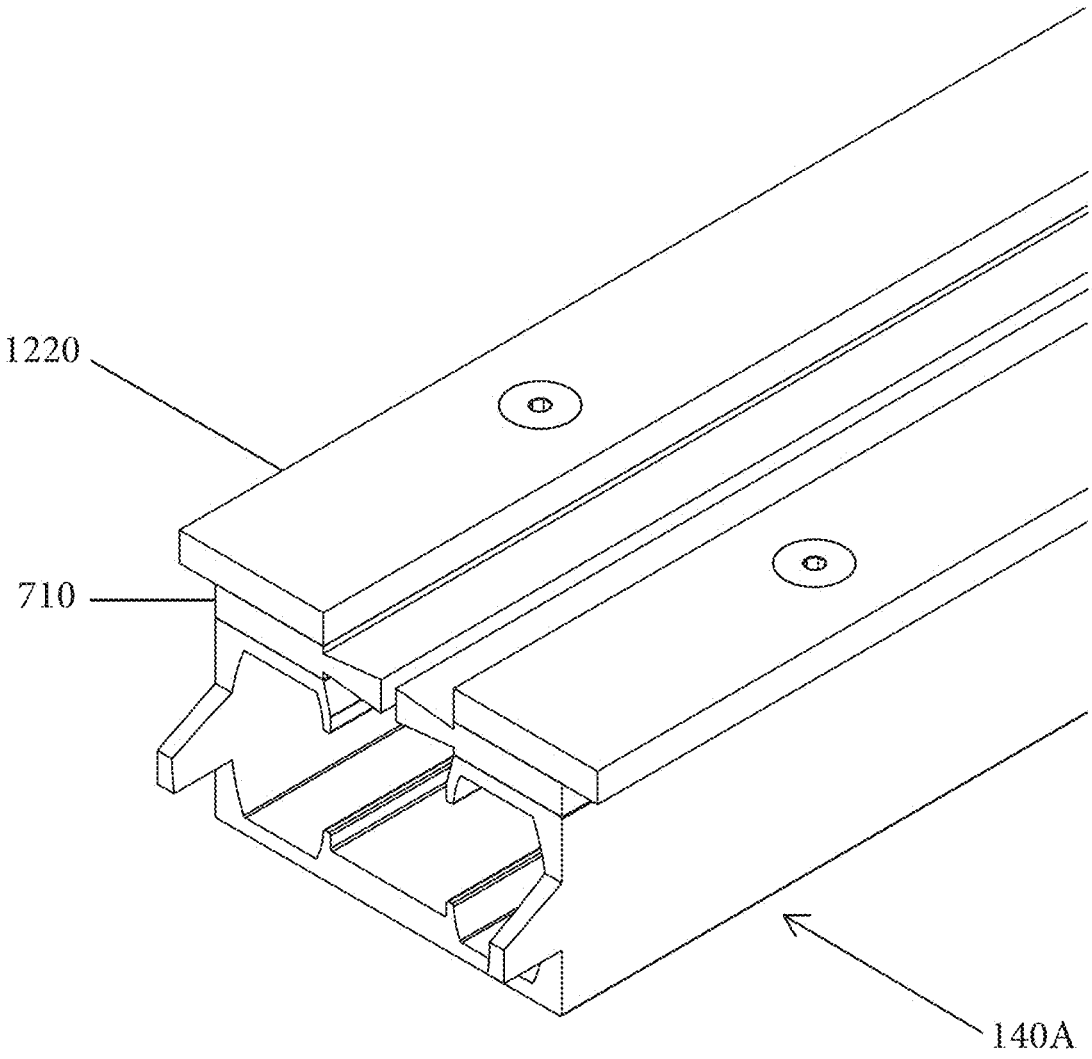
FIG. 12 illustrates an assembled view of a rail track with a cover portion in accordance with one or more embodiments of the present disclosure.
Figure 13:
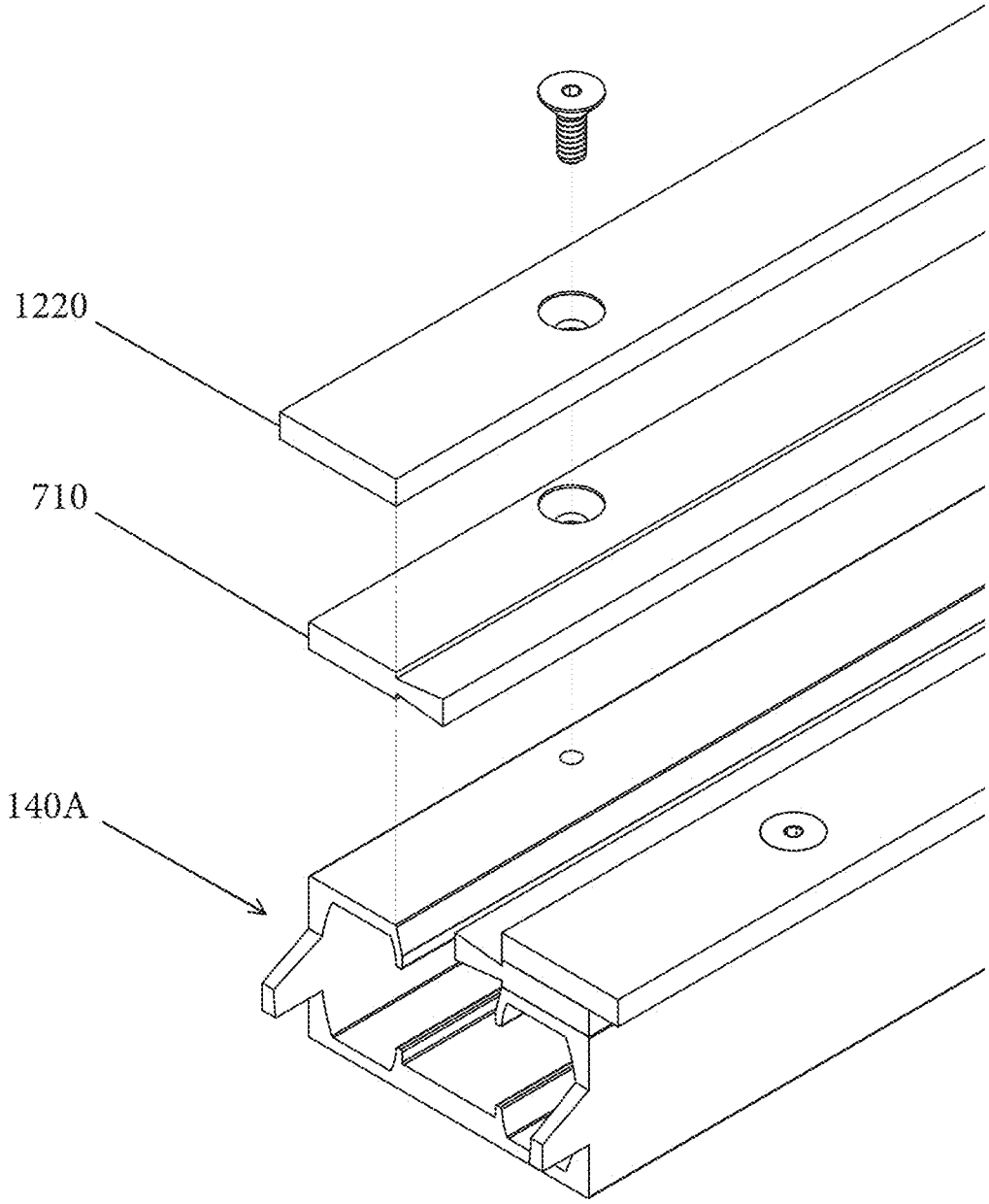
FIG. 13 illustrates another exploded view of a rail track with a cover portion in accordance with one or more embodiments of the present disclosure.

Referring to FIGS. 12 and 13, an exploded view of a rail track 140A with a track assembly cover 1220 in accordance with one or more embodiments of the present disclosure is shown. Track assembly cover 1220 may be fastened to bristle bar 710, the bristle bar coupled to the rail track section 140A in accordance with one embodiment of the present disclosure. Track assembly cover 1220 may include a decorative design and may include a desired color in order to match the adjacent floor or ceiling.

Figure 14:
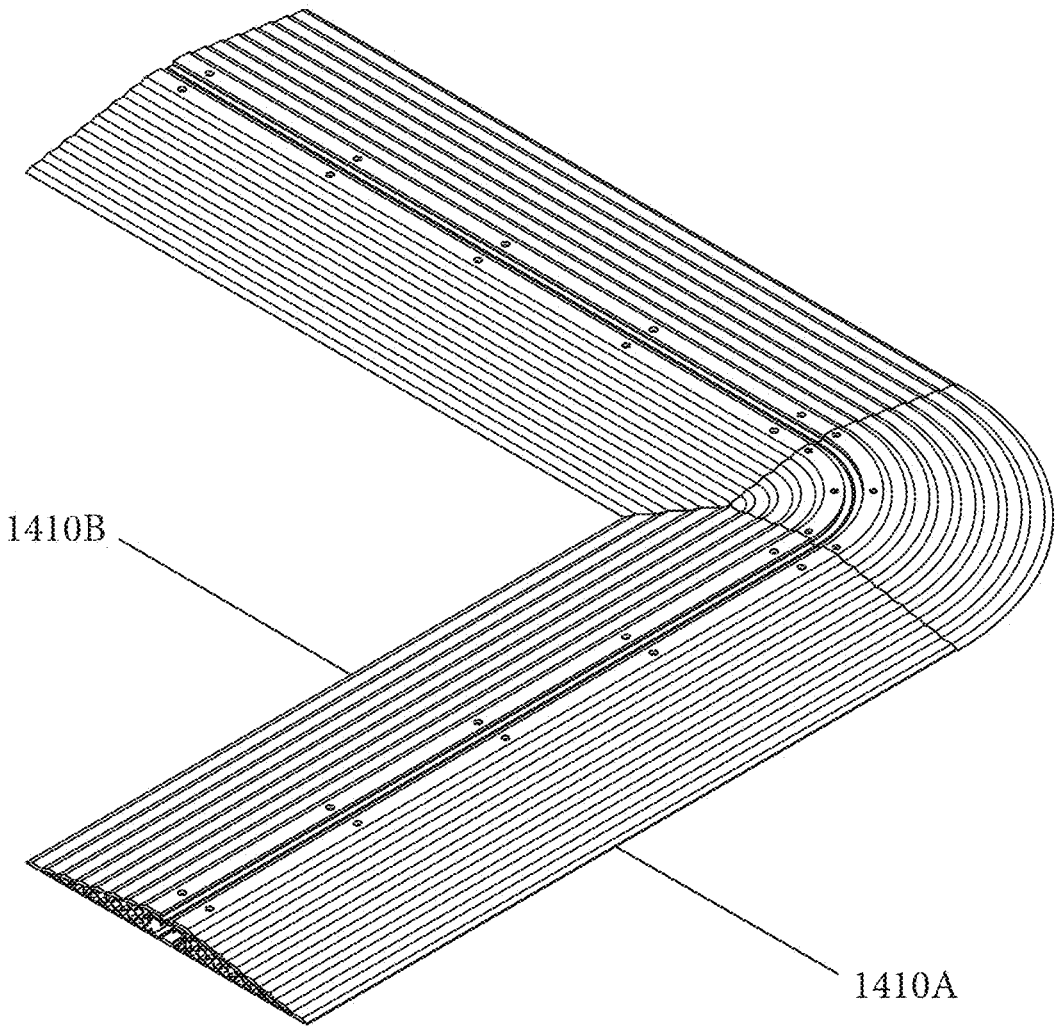
FIG. 14 illustrates a transition assembly for use with the rail track of the modular wall system in accordance with one or more embodiments of the present disclosure.
Figure 15:
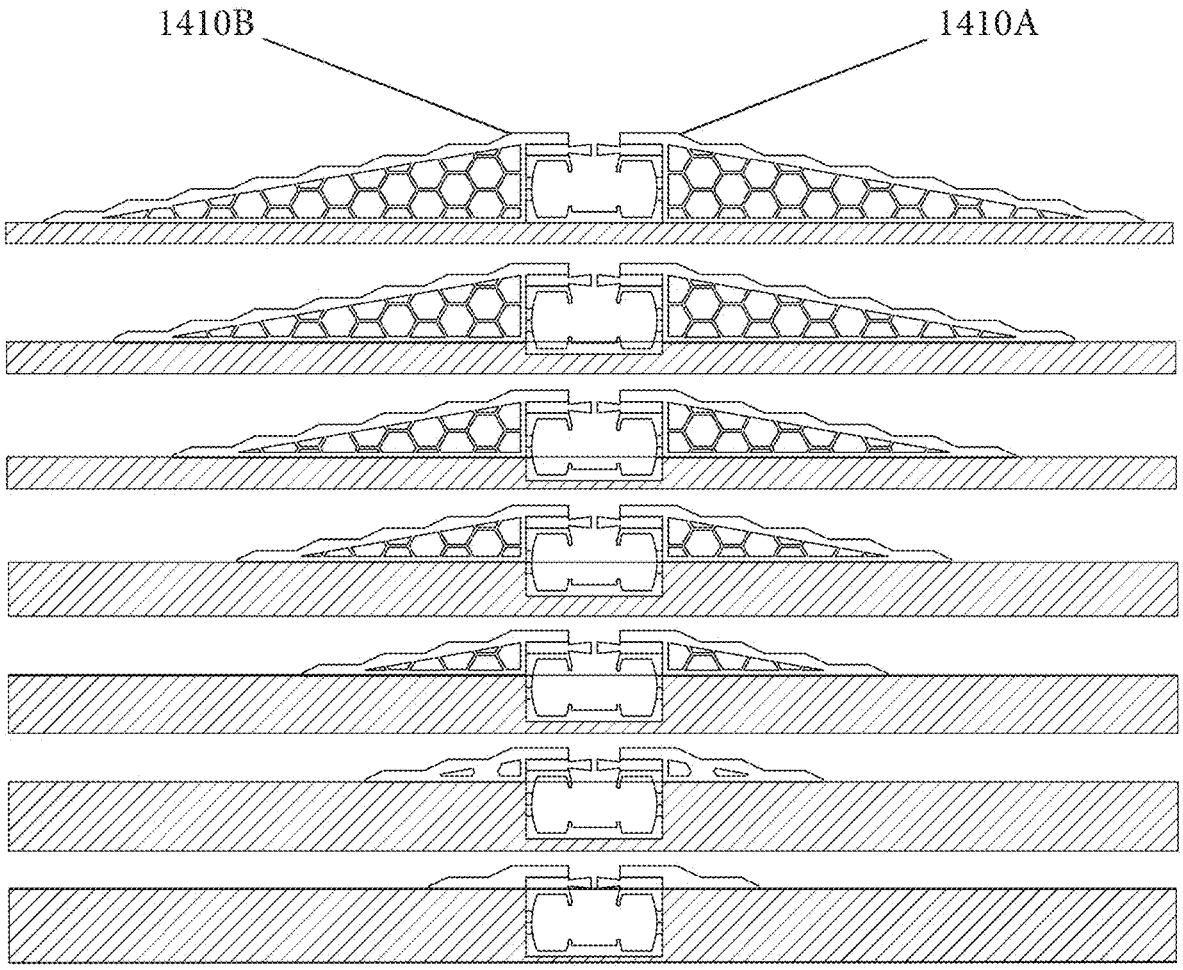
FIG. 15 illustrates cross sectional views of transition assemblies for use with the rail track of the modular wall system in accordance with one or more embodiments of the present disclosure.

Referring to FIGS. 14-15, a transition assembly 1410A, 1410B for use with the rail track 140A of the modular wall system in accordance with one or more embodiments of the present disclosure is shown. The transition assembly 1410A, 1410B may be fastened to the floor and adjacent rail track 140A located on the floor, and may partially cover rail track 140A without impeding movement of the panels and train assemblies. It is contemplated that the transition assembly 1410A, 1410B may be in compliance with provisions of the Americans with Disabilities Act, (ADA). Additionally, as shown in FIG. 15, it may be possible to embed a rail track 140A within the floor or subfloor. In such a fashion, a transition assembly 1410A, 1410B may be employed which would gradually slope in order to meet the height of the rail track. As shown in FIG. 15, a portion of track assembly 1410A, 1410B may be fastened on top of the bristle bar which is coupled to the rail track. Advantageously, the transition assembly 1410A, 1410B may allow easier transport by a user across the rail track when the rail track is located on a floor.

Figure 16:
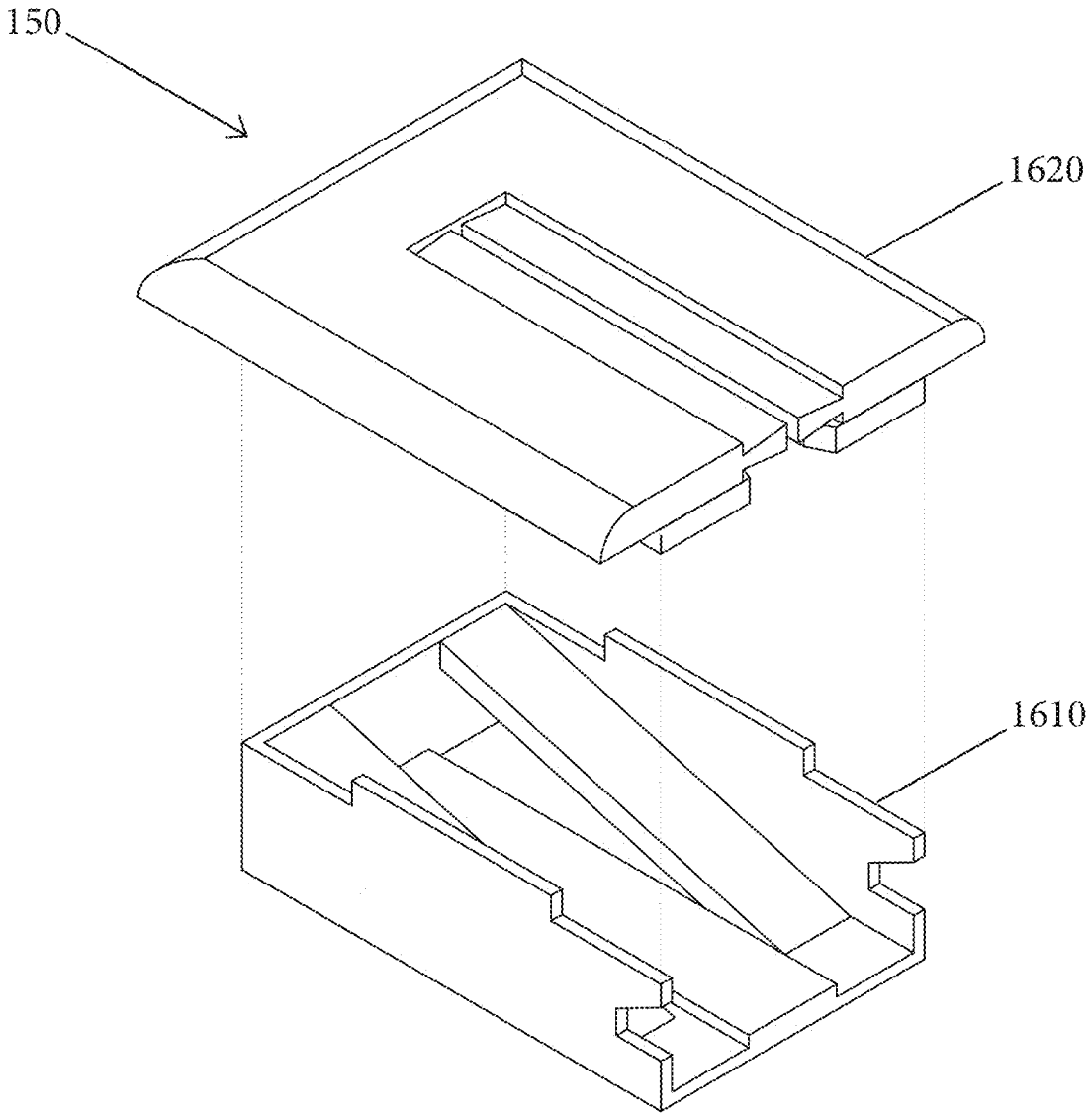
FIG. 16 illustrates an exploded view of the insertion assembly of the modular wall system in accordance with one or more embodiments of the present disclosure.

Referring to FIG. 16, an insertion assembly 150 of the modular wall system in accordance with one or more embodiments of the present disclosure is shown. The insertion assembly 150 may be placed at each end of a rail track to allow insertion of the train assembly and panels to form a modular wall system, as shown in an exemplary manner in FIG. 1. For example, as shown in FIG. 1, insertion assemblies 150A, 150B are located on lower rail track 140A and insertion assemblies 150C, 150D are located on upper rail track 140B. The insertion assembly 150 may include a ramp housing device 1610 to allow the train assembly to roll into the rail track. In embodiments, the insertion assembly 150 may include a ramp housing cover 1620 which connects to the ramp housing device 1610 when installation has been completed. It is contemplated that a bump stopper or a soft close closing component may be installed after the panels have been installed on the rail track. The bump stopper or soft close closing component may minimize damage to the modular wall system when larger amounts of force are applied to the function of the wall. In embodiments, the bump stopper may be made of any material known in the art including, but not limited to, a shock absorbing polyurethane, rubber, or impact-resistant material, and the like.

Figure 17:
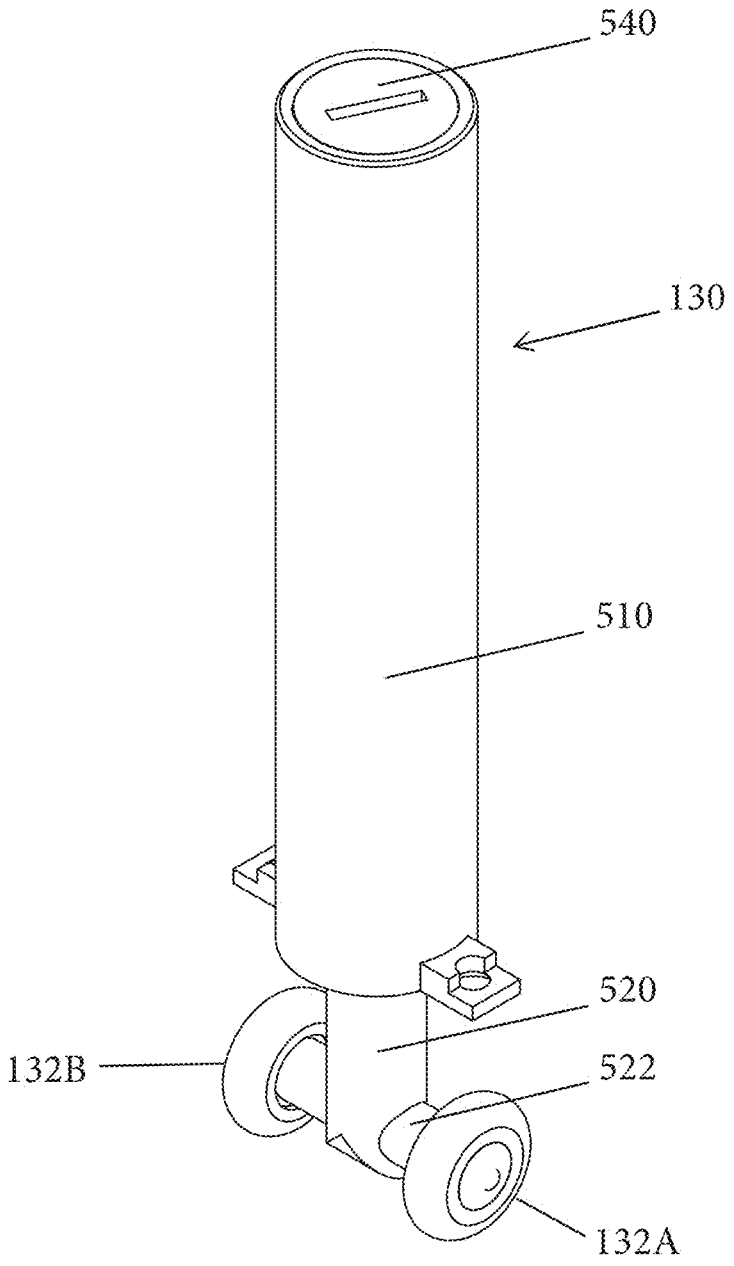
FIG. 17 illustrates a train assembly of the modular wall system in accordance with one or more embodiments of the present disclosure.
Figure 18:
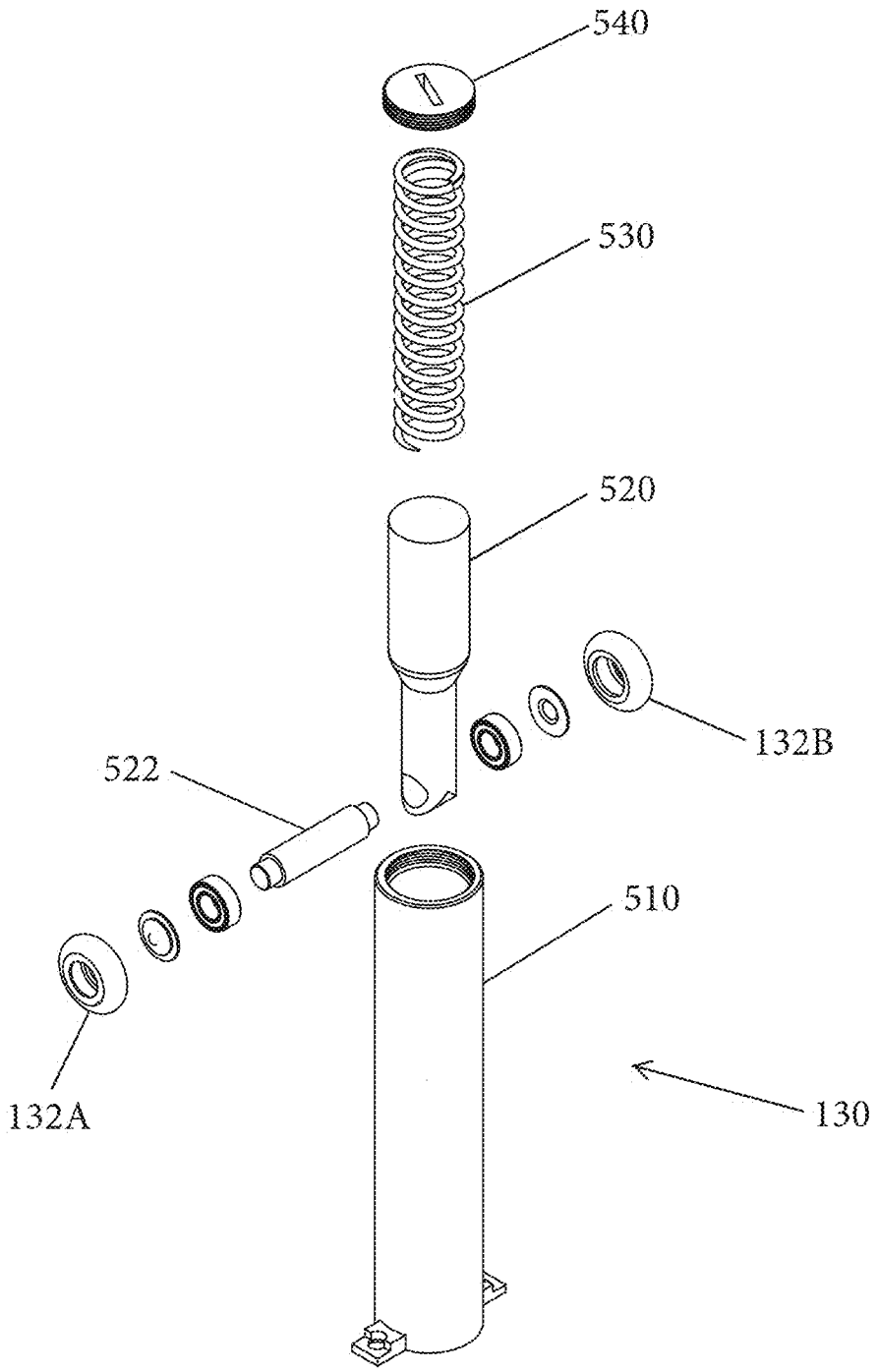
FIG. 18 illustrates an exploded view of a train assembly of the modular wall system in accordance with one or more embodiments of the present disclosure.
Figure 19:
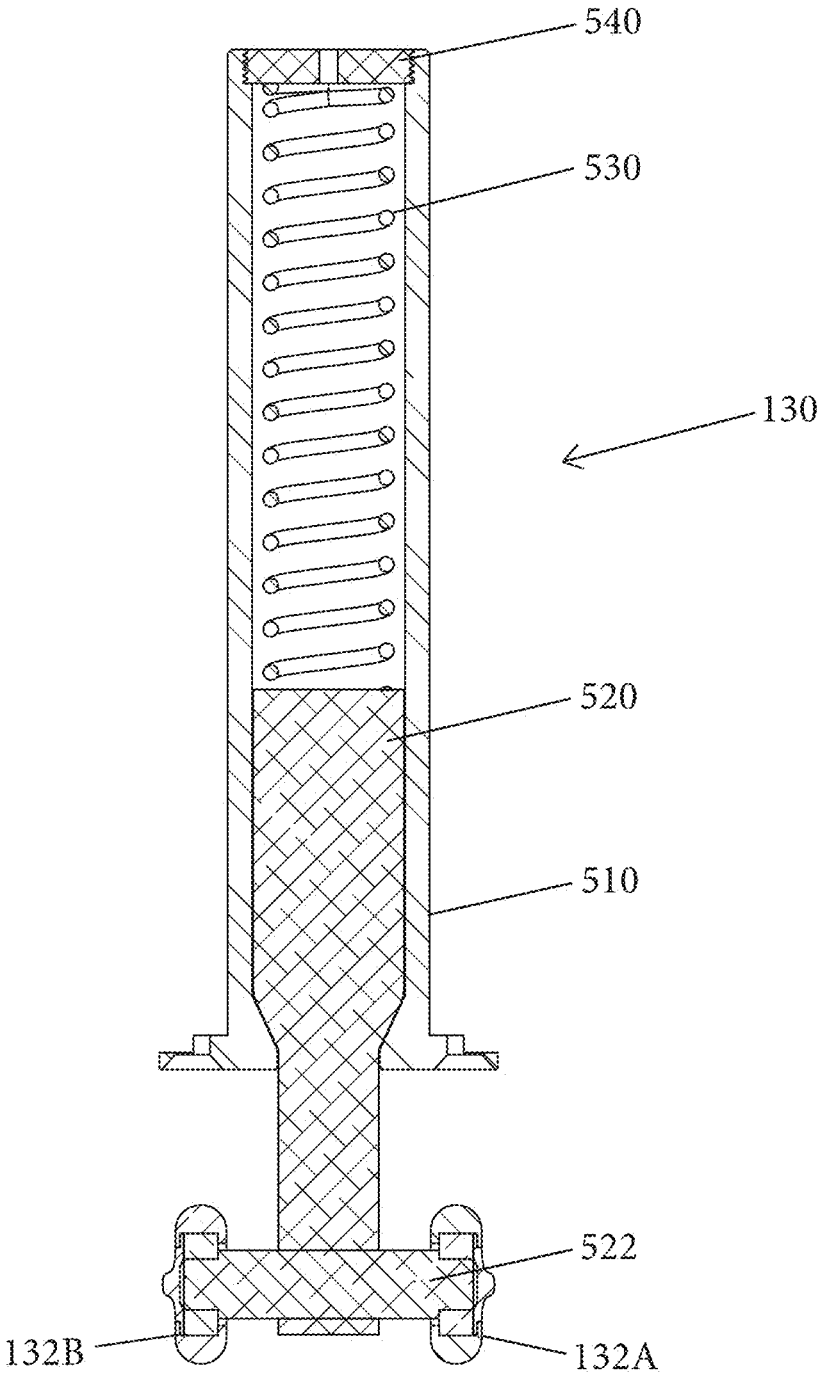
FIG. 19 illustrates a cross sectional view of an assembled train assembly in accordance with one or more embodiments of the present disclosure.

Referring to FIGS. 17-19, a train assembly 130 of the modular wall system in accordance with one or more embodiments of the present disclosure is shown. Train assembly 130 as shown in FIGS. 17-19 may be representative of train assembly 130A, 130B as depicted in FIG. 2. The train assembly 130 may include a piston sleeve 510, and may include a piston 520 within the piston sleeve 510. For example, the piston sleeve 510 may contain the piston 520 and allow the piston to rotate freely. In embodiments, the train assembly 130 may be connected to an end of the panel, and secured to the end of the panel with fasteners. The train assembly 130 may include one or more wheels 132A, 132B. For example, the train assembly 130 may include two wheels 132A, 132B. The piston 520 may be connected to an axle 522, and the one or more wheels 132A, 132B may be connected to the axle 522.

Referring specifically to FIGS. 18-19, train assembly 130 may further include an internal spring 530 and adjustable cap 540 to increase or decrease the force applied by the spring 530 to the piston 520. The force of the spring 530 may be adjusted by rotation of the cap 540, such as by use of a screw driver, to increase or decrease the depth of the cap within the piston sleeve. With use of a spring 530 is contemplated, it is contemplated that a hydraulic force could also be employed with a mechanism to increase or decrease the amount of force applied to the piston 520. The adjustability of the piston 520 allows the train assembly 130 and the modular wall system 100 to account for differences in the level of a floor, ceiling, or mis-matching of the rail tracks 140A, 140B, and allows for a smoother motion of the modular wall system 100 from a first position to a second position, and vice versa. It is contemplated that the train assembly 130 may be formed of a rigid material, such as metal, plastic, composite, or the like.

It is contemplated that the modular wall system 100 may include a powered system to cause movement of the modular wall system 100. The modular wall system 100 may include one or more motion sensors configured to cause the modular wall system 100 to translate between the first position and the second position, and vice versa. For example, the one or more motion sensors may be arranged in proximity to one or more modular wall system 100 and be configured to cause the train assembly to adjust the position of one or more components of the modular wall system 100.

Further, it is contemplated that the modular wall system 100 may include one or more user control devices configured to cause the modular wall system 100 to translate between the first position and the second position, and vice versa. For example, the one or more user control devices may include one or more remotes configured to cause the train assembly to adjust the position of one or more components of the modular wall system 100. The one or more user control devices may be communicatively coupled to one or more components of the modular wall system 100 via any communication method including, but not limited to, Bluetooth, WIFI, USB cable, and the like.

It is contemplated that the modular wall system may be employed as a substantially straight wall. Additionally, it is contemplated that the modular wall system may not necessarily represent a wall, but may refer to any type of movable structure that may be adjusted in order to allow/prevent access to a certain area, such as a dog sitting area, child's area, and the like. In such an embodiment, the plurality of panels may only have a height of two to four feet, for example, whereby the system may not be implemented as a wall but rather a partial enclosure, such as a gate or fence.

It is contemplated that the modular wall system may be fabricated with a variety of high strength, low weight materials in order to be able to be easily moved. Additionally, the panels, connectors, and/or bristles of the bristle bars may be constructed of fireproof material(s) in order to provide additional security benefits. Additionally, the modular wall system may be formed of materials to fortify structure, enhance thermal and acoustic benefits, and the panels may include one or more insulating materials. For example, one or more fire-retardant insertions or coverings may be employed to the modular wall system to prevent spread of fire. It is further contemplated that the modular wall system may be adjusted for various sizes (length, width, and height) in order to be able to be used in a variety of manners.

In another embodiment, it is contemplated that the panels, the connectors, and/or the bristle bars may be employed as a security device and enhance thermal protection for vehicles. Similar to the manner in which screens have been added to new vehicles to allow ventilation but prevent entry of bugs and the like, the panels, the connectors, and/or the bristle bars of the present disclosure may be employed in vehicles. It is contemplated that the modular curved wall system may cover windows when a vehicle is left unattended to assist with thermal protection and to prevent break-in and/or theft of articles within the vehicle.

It is further contemplated that rail track 140A may be placed within a subfloor wherein a top of the rail track 140 may be at a same level as the floor. It is further contemplated that rail track 140B may be placed at least partially within a ceiling wherein a top of each panel 110A-110E may be in close proximity to the level of the ceiling. For example, a cutout portion of the ceiling may be formed and rail track 140B may be installed within the cutout portion of the ceiling. Advantageously, this may be prevent tampering and attempts to knock down the modular wall system 100 in applications where a secure wall may be necessary.

Further, it is contemplated that one or more components of the modular wall system may be concealed. For example, the panels 110A-110E may be concealed by translating the panels 110A-110E into a pocket within an adjacent wall, floor, ceiling, or the like. In this regard, the modular wall system may have pocketing capabilities. For example, one or more rail tracks may be installed so a portion is to be located within a wall, floor, or ceiling. One or more wall portions may be built such that the modular wall system 100 may be stored within the wall, floor or ceiling area and hidden, which may be referred as pocketing the modular wall system 100.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected" or "coupled" to each other to achieve the desired functionality, and any two components capable of being so associated can also be viewed as being "coupled" to each other to achieve the desired functionality. Specific examples of couplable include but are not limited to physically interactable and/or physically interacting components and/or wirelessly interactable and/or wirelessly interacting components and/or logically interactable and/or logically interacting components.

It is believed that the present disclosure and many of its attendant advantages will be understood by the foregoing description, and it will be apparent that various changes may be made in the form, construction, and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A modular wall system, comprising:

a plurality of panels, the plurality of panels including one or more center panels and one or more end panels;

at least one connector configured to connect the one or more center panels with the one or more end panels, the at least one connector formed of a flexible material, the at least one connector includes a generally flat section with rounded edges on each end of the at least one connector, an extrusion on each side of the generally flat section, and a gap filler member connected to each extrusion on each side of the generally flat section;

a train assembly, wherein the train assembly connected to an end of each panel of the plurality of panels, the train assembly including one or more wheels; and a rail track, wherein the one or more wheels of the train assembly are configured to travel within the rail track.

2. The modular wall system as claimed in claim 1, wherein the flexible material of the at least one connector is rubber.

3. The modular wall system as claimed in claim 1, wherein each panel includes a slot which is configured to retain one rounded edge of the rounded edges of at least one connector.

4. The modular wall system as claimed in claim 3, wherein the at least one connector has a same length as each panel.

5. The modular wall system as claimed in claim 1, wherein the train assembly comprises:

a piston sleeve; and a piston disposed within the piston sleeve, wherein the one or more wheels is connected to an axle, the axle connected to the piston.

6. The modular wall system as claimed in claim 5, wherein the train assembly further includes a spring disposed within the piston sleeve.

7. The modular wall system as claimed in claim 1, wherein the rail track includes a plurality of track sections, the plurality of track sections including at least one generally straight track section or a curved track section.

8. The modular wall system as claimed in claim 1, further comprising a second train assembly connected to another end of each panel of the plurality of panels, the second train assembly including one or more wheels.

9. The modular wall system as claimed in claim 8, further comprising a second rail track, the second train assembly including one or more wheels configured to travel within the second rail track.

10. A modular wall system, comprising:

a plurality of panels, the plurality of panels including one or more center panels and one or more end panels, wherein each panel of the plurality of panels is generally rectangular-shaped;

at least one connector configured to connect the one or more center panels with the one or more end panels, wherein the at least one connector includes a generally flat section with rounded edges on each end of the at least one connector, the at least one connector formed of a flexible material;

a train assembly, wherein the train assembly is connected to an end of each panel of the plurality of panels, the train assembly including one or more wheels, a piston sleeve, and a piston disposed within the piston sleeve, wherein the one or more wheels is connected to an axle, the axle connected to the piston; and a rail track, wherein the one or more wheels of the train assembly are configured to travel within the rail track.

11. The modular wall system as claimed in claim 10, wherein the flexible material of the at least one connector is rubber.

12. The modular wall system as claimed in claim 10, wherein each panel includes a slot which is configured to retain one rounded edge of the rounded edges of at least one connector.

13. The modular wall system as claimed in claim 10, wherein the rail track includes a plurality of track sections, the plurality of track sections including at least one of generally straight track section or a curved track section.

14. The modular wall system as claimed in claim 10, further comprising a second train assembly connected to another end of each panel of the plurality of panels, the second train assembly including one or more wheels.

15. The modular wall system as claimed in claim 10, further comprising a second rail track, the second train assembly including one or more wheels configured to travel within the second rail track.

16. The modular wall system as claimed in claim 10, wherein the at least one connector includes an extrusion on each side of the generally flat section.

17. A modular wall system, comprising:

a plurality of panels, the plurality of panels including one or more center panels and one or more end panels;

at least one connector configured to connect the one or more center panels with the one or more end panels, the at least one connector formed of a flexible material;

a train assembly, wherein the train assembly connected to an end of each panel of the plurality of panels, the train assembly including one or more wheels, a piston sleeve, and a piston disposed within the piston sleeve, wherein the one or more wheels is connected to an axle, the axle connected to the piston; and a rail track, wherein the one or more wheels of the train assembly are configured to travel within the rail track.

18. The modular wall system as claimed in claim 17, wherein the train assembly further includes a spring disposed within the piston sleeve.

19. The modular wall system as claimed in claim 17, wherein the rail track includes a plurality of track sections, the plurality of track sections including at least one generally straight track section or a curved track section.

20. The modular wall system as claimed in claim 17, further comprising a second train assembly connected to another end of each panel of the plurality of panels, the second train assembly including one or more wheels.

* * * * *